US006248284B1

(12) United States Patent
Huusmann

(10) Patent No.: US 6,248,284 B1
(45) Date of Patent: Jun. 19, 2001

(54) PROCESS FOR PREPARING PARTICLES COVERED WITH A LAYER OF WATER GLASS AND ARTICLES COMPRISING SUCH COVERED PARTICLES

(75) Inventor: Ole Huusmann, Roskilde (DK)

(73) Assignee: DTI Industri, Taastrup (DK)

( * ) Notice: Subject to any disclaimer, the term of this patent is extended or adjusted under 35 U.S.C. 154(b) by 0 days.

(21) Appl. No.: 09/331,295

(22) PCT Filed: Dec. 17, 1997

(86) PCT No.: PCT/DK97/00575

§ 371 Date: Jun. 18, 1999

§ 102(e) Date: Jun. 18, 1999

(87) PCT Pub. No.: WO98/29208

PCT Pub. Date: Jul. 9, 1998

(30) Foreign Application Priority Data

Dec. 18, 1996 (DK) ..... 1441/96

(51) Int. Cl.[7] ..... B22C 1/18; B29B 9/00; B29C 35/08

(52) U.S. Cl. ..... 264/463; 106/38.3; 106/38.35; 164/45; 264/71; 264/219

(58) Field of Search ..... 264/71, 219, 463; 106/38.3, 38.35; 164/45

(56) References Cited

U.S. PATENT DOCUMENTS

| | | | |
|---|---|---|---|
| 1,889,007 | 11/1932 | Wallace . | |
| 2,947,641 | 8/1960 | Bleuenstein | 106/38.3 |
| 3,255,024 | 6/1966 | Alexander et al. | 106/38.3 |
| 3,508,936 | 4/1970 | Lyass et al. | 106/38.35 |
| 3,802,902 | 4/1974 | Turner, Jr. et la. | 106/38.3 |
| 3,804,643 | 4/1974 | Arita et al. | 106/38.35 |
| 4,331,197 | 5/1982 | Cole | 164/522 |
| 4,347,890 | 9/1982 | Ailin-Pyzik et al. | 164/528 |
| 5,158,130 | 10/1992 | Sahari | 164/528 |

FOREIGN PATENT DOCUMENTS

| | | |
|---|---|---|
| 28 56 267 A1 | 7/1980 | (DE) . |
| 89565 | 7/1993 | (FI) . |
| 9001952 | 6/1991 | (SE) . |
| WO 95/15229 | 6/1995 | (WO) . |

*Primary Examiner*—Leo B. Tentoni
(74) *Attorney, Agent, or Firm*—Seed Intellectual Property Law Group PLLC

(57) ABSTRACT

The invention relates to a process for preparing free flowing particles covered with a layer of water glass, comprising the steps of: (a) providing a mixture containing particles to be covered, water and 0.1–5% by weight water glass, calculated on the basis of the weight of the particles, the water glass being dissolved in said mixture, and (b) stirring the mixture mechanically, optionally by supplying heat from an external heat source, and permitting the water to evaporate from the mixture until at least so much water is evaporated that said mixture is no longer sticky. Furthermore, the invention relates to a process for preparing an article with a detailed surface.

24 Claims, No Drawings

PROCESS FOR PREPARING PARTICLES COVERED WITH A LAYER OF WATER GLASS AND ARTICLES COMPRISING SUCH COVERED PARTICLES

TECHNICAL FIELD

The present invention relates to a process for preparing particles covered with a layer of water glass and a process for preparing articles comprising such covered particles. Furthermore, the invention concerns such particles and articles obtainable by these processes.

When casting metal and plastic objects, moulds and cores of various materials are used. The present invention is directed to such cases where the main ingredient of the material in the moulds and cores is constituted by solid particles such as sand.

BACKGROUND

To adhere the solid particles, different types of binders have been used. Such binders can be of either organic or inorganic nature. Organic binders are usually phenol-based and to a large extent preferred by iron and metal foundries. However, phenol-based binders are detrimental to the environment as during the casting, the heating of phenol-based binders entails pyrolysis whereby CO and polyaromatic hydrocarbons (PAH) are released, among others. Furthermore, the casting leaves some sand which is polluted with toxic organic compounds. The European iron and metal foundries alone produce 7,000,000 tons of polluted sand every year.

Consequently, extensive research has been performed to provide inorganic binders. The use of water glass as a binder has been suggested but so far, the use of water glass as a binder has not been widespread within the iron and metal casting industry.

Water glass as a binder was used to adhere sand in foundries for the first time about 1920. In this process, sand is mixed with an aqueous solution of water glass, and this mixture is subsequently filled into a mould to be cured by evaporation of the water. This process was essentially improved about 1950 by the development of the $CO_2$ process in which the $CO_2$ gas is led through the wet mixture of sand and water glass in order to cure the binder. Cores and moulds obtained by the $CO_2$ process are relatively porous and their strength is weak.

At the end of the 1960s, self-curing binding systems were developed. The curing is effected by supplying an organic ester to the wet mixture of sand and water glass before filling it into a mould.

At the end of the 1970s, there was developed a dry curing process where energy from warm air, a warm mould, or microwaves entail curing of the water glass binder.

In the early nineties, the present inventor developed a curing process where warm air was blown into a ventilated mould by use of a three-step temperature cycle, cf. "Miljøprojekt nr. 189, Miljøstyrelsen".

All the aforesaid processes in which water glass is used as a binder have, however, the inconvenience that the flowing properties of the mixture of sand, water glass, and water are relatively poor when filling the mould. This entails that the mixture tends not to flow into all the cavities of the mould. The known processes using water glass are thus limited to be used in connection with moulds showing no detailed surface.

SUMMARY

Therefore, it is the object of the present invention to procure a process for preparing a free flowing product which can be used to fill moulds with a detailed surface. It is further the object to procure a process for preparing an article comprising such a free flowing particle which article can be obtained with a detailed outer design.

Consequently, the present invention relates to a process for preparing particles covered with a layer of water glass, which process is characterized by the steps of (a) providing a mixture containing particles to be covered, water and 0.1–5% by weight water glass, calculated on the basis of the weight of the particles, the water glass being dissolved in said mixture, and (b) stirring the mixture mechanically, optionally by supplying heat from an extern heat source, and permitting the water to evaporate from the mixture until at least so much water is evaporated that said mixture is no longer sticky.

The invention further concerns particles covered by an essentially unbroken layer of water glass obtainable by this process.

DETAILED DESCRIPTION

The term "water glass" in the present description and claims is to be understood as sodium or potassium silicates. The sodium or potassium component ($M_2O$, M Na or K) can be in variable quantities in relation to the silicate component ($SiO_2$). The ratio $SiO_2/M_2O$ is designated the weight module. A water glass with a low weight module is easily soluble in water and strongly basic because a high content of the basic component $M_2O$. Correspondingly, a water glass possessing a high weight module, has a smaller basic character, and a smaller water solubility. In this invention, the use of water glass with a weight module between 0.5 and 4, especially betwen 1.8 and 3.5, is preferred. Furthermore, M=Na is preferred.

For water glass with a weight module of up till about 3.0, it is possible to dissolve this immediately by contact with water at room temperature within a reasonable period of time, e.g. within 10 min. For water glass with a weight module over about 3.0, e.g. module 3.0 to 3.5, it is appropriate to predissolve the solid water glass in water with a temperature of up till 100° C. or to heat the particles to a temperature of up till 100° C., preferably 80–90° C., before supplying water and water glass to ensure an essentially completely dissolving of the water glass.

The particles to be covered with a layer of water glass can be any material to which water glass can adhere.

Examples of such materials are metallic materials and ceramics. Examples of usable metallic materials are aluminium, copper, iron, tungsten, chrome, vanadium and manganese. Examples of ceramics are $SiO_2$ (quartz sand), $TiO_2$, $ZrO_2$, $Al_2O_3$, CaO and MgO.

The size and the size distribution of the particles are not essentiel to the production of the covered particles according to the invention. For use in mould and core boxes, it is in general preferred to use particles with a size of from 0.05 mm to 2.0 mm, especially 0.10 to 0.60 mm. The selected particles can have a broad or narrow particle size distribution or the particle mass can be composed by socalled double sieved particles (double sieved sand) in which there are two peaks on the grain size curve.

The quantity of water in the mixture in step (a) depends on several factors, such as the specific surface, porosity and the electrostatic nature of the particles, but is preferably at least 0.1% by weight, calculated on the weight of particles to be covered. A quantity of typical 1–3% by weight is chosen to ensure a sufficient humidification of the particles. The quantity of water does preferably not surpass 5% by weight as supplying water in surplus of this quantity will not contribute further to the humidification of the surface of the particles to be covered.

The quantity of water glass in the mixture comprising particles to be covered, water, and water glass, depends on factors such as the desired thickness of the layer and the specific surface of the particles to be covered. According to the invention, 0.1–5% by weight water glass can be used, calculated on the basis of the weight of the particles. It is in general preferred to use 1–3% by weight.

The mixture in step (a) is obtained preferably by the steps of (a1) mixing water and particles to be covered, (a2) stirring the mixture such that the water is distributed evenly in the particle mass, (a3) supplying 0.1–5% by weight water glass to this mixture, and (a4) continuing the stirring until the water glass is evenly distributed and dissolved.

In step (a2) the water glass is preferably supplied to the mixture in solid state, it being preferred to use particles of water glass prepared by spray drying.

It appeared expedient to effect a stirring during the entire course of production of the particles covered with a layer of water glass. This stirring is mechanical, preferably by use of rotating wings. The stirring velocity is adjusted to ensure that no cured lumps of particles are formed which subsequently have to be broken.

As the adhesion tendency of the mixture increases strongly during the evaporation of the water, it has proven expedient to use a container of plastic for the mixture to which the water glass has little tendency to adhere. The stirring is preferably effected with such an intensity that the mixture is heated and such that the water evaporates. If desired, heat can be provided from an external source and/or evaporation can be effected in vacuum in order to increase the evaporation velocity. When required, the used particles can be preheated prior to the mixture with water and water glass. This is especially advantageous if the used water glass is sparingly soluble, i.e. has a weight module from 3.0 to 4.0 wherein it is preferred to heat the particles to a temperature of up till 100° C., preferably 80–90° C., before the particles are mixed with water and water glass.

When mixing, there should be no lumps of either sand or water glass before an essential evaporation of the water is allowed. During the evaporation of the water from the mixture, the viscosity increases and after a while, the mixture will be sticky, whereby particles tend both to adhere to each other, and to adhere to the used apparatus. The stirring must be adapted to this adherence tendency such that a too strong mutual binding of the particles is prevented. When the water content in the layer of water glass has dropped below the lowest level where binding is pos-sible between the particles, the viscosity decreases again. The stirring may be continued until all the water is evaporated and the dry particles covered with a layer of water glass are provided, but the humidified and nonsticky particles can be taken out at a previous time with a view to immediate subsequent further processing. Unexpectedly, it has turned out that such particles covered with water glass have outstanding flowing properties, both in a dry form and a slightly wet, but nonsticky, form.

These flowing properties are supposedly obtained both as a consequence of the layer of water glass being smooth and hard and as a consequence of the covered particles, during drying, exercising an influence on each other such that the produced covered particles have a more rounded form in relation to the uncovered particles.

The particles obtainable by the proces indicated above can, according to the invention, be further processed to an article by a process characterized by the steps of (c) providing particles covered with water glass in a mould, (d) ensuring the presence of water for activation of water glass in the particle mass, and (e) curing the particles covered with water glass in the mould to an article by supplying energy from a source thereof.

The term "mould" in the present description and claims indicates among other, mould boxes and core boxes for preparing moulds for use with iron and metal casting or injection moulding of plastics and cores for use with iron and metal casting, respectively. Furthermore, models are to be understood as casts wanted to obtain an article with an outer negative surface corresponding to that of the positive model.

The particles covered with water glass can be procured in the mould in an arbitrarily chosen way. In a first preferred embodiment, the particles is filled in bulk into a mould whereupon the mould is slightly vibrated in order to fill all cavities and to obtain a tight and uniform packing. By such a vibration the smaller particles will move towards the surface of the particle mass and thus increase the density of the surface of the article. After vibration of the in-bulk filled particles, there may be vibrated afterwards under influence of the particles with a suitable pressure e.g. with a plumb to promote a tighter packing of the particles.

In another prefered embodiment, the particles covered with water glas are obtained in the mould by blowing the particles borne by an airflow into the mould. The carrier airflow escapes through valves in the mould and the particles will be packed in the mould under influence of the pressure of the airflow.

In yet another preferred embodiment, the particles covered with water glass can be provided in the mould by extrusion of the particles into the mould by a process designated "impact moulding". By this process, the particles are bumped into the mould under influence of a major pressure which can be effected e.g. by suddenly released compressed air.

By the presence of water in the particle mass and by supplying energy from a source, the water glass will be activated such that a coherent article is formed. Thus, water must be provided for activation of the water glass in the particle mass. This water can be e.g. crystallization water, be supplied as aqueous vapour, or the used particles can comprise a minor quantity of water before filling the mould, e.g. from 0.1 to 0.7% by weight water, preferably about 0.3% by weight. The energy source for the curing can be e.g. a source for microwaves or high-frequency waves, warm air, convection heat or vapour.

In a first preferred embodiment, vapour is led through the particles covered with water glass and provided in a mould in order to activate the water glass layer. Compressed air is then supplied at a temperature of 160–200° C. to effect a further heating of the covered particles and a beginning evaporation of the water. Subsequently, the temperature is lowered to 80–160° C. to remove the water from the produced article. There might eventually be used a compressed air temperature of 0–80° C. to effect cooling of the article and the mould. During humidification of the particles covered with water glass in the mould with vapour, the humidity should be essentially uniformly distributed in all areas of the mould without the water glass being rinsed off the particles.

A variant of this embodiment uses particles covered with water glass which are humidified with up to 0.7% by weight water instead of vapour for humidification the covered particles. The pressure of the compressed air and the duration of the various temperature periods vary depending on the quantity of water used for humidification, the size of the article, the quantity of used water glass, etc., and such periods can be defined by the person skilled in the art by routine tests. A typical distribution of the duration of the different temperature periods when producing an article of 10 kg where the particles are quartz sand with an average grain size of 0.30 mm covered with a water glass quantity of 0.8% by weight (module 2.0) and humidified with a water quantity of 1% by weight, is the following for an air pressure of 700 kPa: 10 seconds air pressure at a temperature of 160–200° C., 30 seconds at a temperature of 80–160° C., and 20 seconds at room temperature. When changing the temperature, it is advantageous to maintain the same pressure in order to avoid breaks of the article.

In another preferred embodiment the particles covered with water glass are cured by microwaves or high-frequency waves. The water required for activation of the water glass can be present as crystallization water in the water glass layer, can be supplied by using humidified particles with a water content of 0.1 to 0.7% or can be provided by supplying water vapour. As to the latter, it appeared to be possible to obtain curing of an article by placing a mould containing particles covered with water glass in a microwave oven where the charging opening faces a humidified blotting paper.

A third preferred embodiment is to use moulds which are provided with heat by convection. e.g. by placing the moulds in an oven, by placing the moulds on a heating plate or by using a mould with a heating jacket.

No matter which of the three said embodiments is used for curing an article, an article is obtained of a plurality of particles which are linked together by means of a layer of water glass. It has turned out that it is possible to produce articles which do not shrink essentially during the curing such that an essentially exact cast of the mould is obtained. This property is particularly advantageous when casts of a model is to be taken in order to produce an article which can be used as a mould for the production of essentially identical copies of models.

Furthermore, it is possible to produce an article which is a cast of a model where the size of the cast is either larger or smaller than the surface of the model by adjusting the temperature of the model. This property can be used advantageously if the model to be copied is a wearing part where an oversize copy is desired.

If the article is intended to be used in connection with iron and metal casting, the used particles are preferably quartz sand. If the produced articles is a core and this core must be removed after the metal casting process, it is preferred to use water glass with a low module, i.e. up to module 3.0 as the core will then be easily rinsed away by water after the casting.

If the produced article is to be used as mould tools, it is expedient to use particles of metal. If a poorer solubility of the mould tools in water is desired, a sparingly soluble water glass is preferably used, i.e. a water glass with a module of 3.0–3.5. The mould tools may e.g. be used for plastic injection moulding, optionally after a surface treatment hereof.

It has appeared that an article produced by metal particles covered with water glass cannot carry electric power which is an indication of the completeness of the cover around the particles.

EXAMPLE 1

Preparing of Quartz Sand Covered with Water Glass with a Low Weight Module 3.0 kg quartz sand with an average grain size of 0.26 mm was weighed and placed in a cylindrical plastic container with a diameter of 200 mm and a height of 190 mm. The plastic container was provided with a stirrer comprising a central axis from which four wings extend. The length of the wings is 95 mm. The stirrer was started and adjusted to a rotational speed of 450 revolutions per minute.

During the stirring, 60 ml water was supplied to the quartz sand and the mixing went on for about one minute in order to distribute the water in the quartz sand. Subsequently, 60 g solid water glass with a weight module of 2.0 was supplied to the mixture of quartz sand and water. A practically immediate dissolution of the water glass was observed.

The stirring was continued for about 60 minutes which can be divided into three periods.

Period 1: 0–30 minutes after supplying water glass, the mixture is heated by the mechanical energy supplied from the stirrer, and water is allowed freely to evaporate;

Period 2: 30–45 minutes after supplying the water glass, the evaporation of the water is so advanced that the water glass begins to be sticky, and a tendency to formation of loosely coherent agglomerates can be observed. Towards the end of the interval, the stickiness of the mixture decreases as the quantity of water in the mixture falls below the lowest binding level and the agglomerates are broken by the stirring. The water content of the mixture is about 0.7% by weight at the end of this period;

Period 3: 45–60 minutes after supplying the water glass, the remaining free quantity of water evaporates whereupon quartz sand covered with water glass is obtained. The temperature of the obtained product is about 60° C.

The obtained product is in a microscope observed to have an even and smooth cover of water glass which is presumed to be the reason for the observed free flowing property.

If a high storage stability is not required, the product may used after the end of period 2 direct in the further processing.

EXAMPLE 2

Preparing of Iron Powder Covered with Water Glass with a Low Weight Module

The same procedure as in example 1 was used, however, 6.0 kg iron powder with an average grain size of 0.10 mm was used instead of quartz sand, and 180 ml water and 180 g solid water glass with a weight module of 2.0 was used.

A free flowing product of iron particles covered with water glass was obtained.

EXAMPLE 3

Process for Preparing Quartz Sand Covered with Water Glass with a Low Weight Module on an Industrial Scale A horizontal stationary drum with a length of 1500 mm and a diameter of 900 mm provided with a rotative shaft on which 4 sets of mixing wings are mounted, was started and adjusted to a rotational speed of 130 revolutions per minute. Subsequently, 200 kg quartz sand with an average grain size of 0.26 mm and then 4.0 l water were supplied during continuous stirring. After about one minute, 4 kg water glass with a weight module of 2.0 was supplied and the stirring continued for 75 minutes while water was allowed freely to evaporate in order to obtain quartz sand covered with water glass of the same type as obtained according example 1.

EXAMPLE 4

Process for Producing Quartz Sand Covered with Water Glass with a High Weight Module 3.0 kg quartz sand with an average grain size of 0.26 mm was heated to a temperature of about 90° C. and placed in the container described in example 1 and provided with the stirrer which is also described in said example whereupon the stirrer is started and adjusted to a rotational speed of 450 revolutions per minute. 90 ml water is supplied to the sand and stirred for 15–30 seconds whereupon 60 g water glass with a weight module of 3.0 is supplied. The water glass is dissolved practically immediately.

The stirring is continued for about 45 minutes while the water is allowed freely to evaporate. The same periods as described in example 1 are passed through, however, with the difference that period 1 is 0–15 minutes and that a larger adhesion tendency appears in period 2.

The obtained quartz sand covered with water glass with a high weight module possesses good flowing properties.

EXAMPLE 5

Preparing of an Article Comprising Quartz Sand Covered with Water Glass

Quartz sand covered with water glass produced according to example 1, was loosely filled into a mould with a volume of about 4 liters (corresponding to a sand weight of about 2200 g), whereupon the mould with the covered sand was vibrated with a free surface in 3 minutes with 2900 vibrations per minute. The dimension of the surface was 250 mm×280 mm. The surface of the covered sand was levelled with a blade, and a plumb of aluminium covering the entire surface and with a weight of 5.0 kg was placed on the surface. Subsequently, the vibrations went on for further 2 minutes and the plumb was then removed. A water absorbent fibre fabric was placed over the surface of the sand and the fibre fabric was wetted with 40 g water. The plumb was placed on the fibre fabric and a heating plate positioned on the plumb. The evaporated water was ensured not to escape to an essential extent, but essentially to be distributed in the sand.

Within one hour the plumb was heated to 175° C. whereby the water in the fibre fabric evaporated, and humidified and activated the water glass layer. The temperature of the mould at the end of the heating is about 90° C. The heating plate, plumb and fibre cloth are then removed.

The mould was heated to 150° C. within 30 minutes and this temperature was maintained for yet an hour. The mould containing the produced article is then allowed voluntarily to cool to room temperature.

EXAMPLE 6

Preparing of an Article Comprising Iron Powder Covered with Water Glass

Iron powder covered with water glass, produced according to example 2, was processed to an article by using the same method as indicated in example 5. The obtained article was not conductive which indicates the completeness of the water glass cover around the iron powder.

What is claimed is:

1. A process for preparing particles covered with a layer of water glass, comprising the steps of:

(a) providing a mixture containing particles to be covered, water and 0.1–5% by weight water glass, calculated on the basis of the weight of the particles, the water glass having a weight module of from 1.8 to 3.5, and being dissolved in said mixture; and (b) stirring the mixture mechanically, optionally by supplying heat from an external heat source, and permitting the water to evaporate from the mixture until at least so much water is evaporated that said mixture is no longer sticky;

whereby particles covered by a layer of water glass are prepared.

2. The process according to claim 1 wherein the energy for the evaporation of the water mainly stems from the mechanical stirring.

3. The process according to claim 1 wherein the quantity of water in step (a) amounts to 0.1 to 5% by weight, calculated on the basis of the weight of the particles.

4. The process according to claim 1 wherein the mixture in step (a) is provided by the steps of:

(a1) mixing particles to be covered and water;

(a2) stirring the mixture such that the water is distributed evenly in the particle mass;

(a3) supplying water glass to this mixture; and (a4) continuing the stirring until the water glass is evenly distributed and dissolved.

5. The process according to claim 4 wherein the particles in step (a1) are present at a temperature of up to 100° C.

6. The process according to claim 1 wherein the particles which are covered comprise a metal or a ceramic.

7. The process according to claim 1 wherein the stirring and evaporation in step (b) is continued until essentially all free water is evaporated.

8. A process for preparing an article comprising particles covered with a water glass layer, which particles are obtainable by the process according to claim 1, comprising the steps of:

(c) providing the particles covered with water glass in a mould;

(d) ensuring the presence of water for activation of water glass in the particle mass; and (e) curing the particles covered with water glass in the mould to an article by supplying energy from a source thereof.

9. The process according to claim 8 wherein the particles in step (c) are provided in the mould by filling the particles in the mould and vibrating the mould with the particles.

10. The process according to claim 9 wherein the particles in the mould are loosely vibrated and subsequently vibrated under influence of a pressure to promote a tighter packing of the particles.

11. The process according to claim 8 wherein the particles in step (c) are provided in the mould by blowing the particles borne by an air current into the mould.

12. The process according to claim 8 wherein the particles are bumped into the mould under influence of pressure sufficient to extrude the particles into the mould.

13. The process according to claim 8 wherein the particles when filled into the mould have a water contend of 0.1 to 0.7% by weight, calculated on the basis of the weight of the particles.

14. The process according to claim 8 wherein the particles in step (d) are humidified with water vapour.

15. The process according to claim 8 wherein the energy source is a source for microwaves, high-frequency waves, or heat.

16. The process according to claim 8 wherein the article is cured by blowing in air at a temperature of 160–200° C. in the mould.

17. Particles covered by an essentially unbroken layer of water glass which are made by the process according to claim 1.

18. The process of claim 1, further comprising the steps of forming a core or a mould for iron or metal casting, or for plastic injection moulding, and forming an iron or metal casting, or plastic injection, therefrom.

19. An article made by the process according to claim 8.

20. The process according to claim 1 wherein the quantity of water in step (a) amounts to especially 1 to 3% by weight, calculated on the basis of the weight of the particles.

21. The process according to claim 4 wherein the particles in step (a1) are present at a temperature ranging from 80 to 90° C.

22. The process according to claim 6 wherein the metal is aluminum, copper, iron, tungsten, chrome, vanadium or manganese.

23. The process according to claim 6 wherein the ceramic is quartz sand.

24. The process according to claim 8 wherein the particles when filled into the mould have a water contend of about 0.3% by weight, calculated on the basis of the weight of the particles.

* * * * *